United States Patent [19]

Ulveling

[11] 4,325,312

[45] Apr. 20, 1982

[54] METHOD AND INSTALLATION OF INJECTION OF SOLID FUELS INTO A SHAFT FURNACE

[75] Inventor: Leon Ulveling, Luxembourg, Luxembourg

[73] Assignee: Paul Wurth S.A., Luxembourg

[21] Appl. No.: 166,618

[22] Filed: Jul. 7, 1980

[30] Foreign Application Priority Data

Jul. 17, 1979 [LU] Luxembourg ..... 81519

[51] Int. Cl.[3] ..... F23D 1/00

[52] U.S. Cl. ..... 110/347; 110/263; 110/265; 110/302; 266/187

[58] Field of Search ..... 110/347, 263, 265, 297, 110/302; 266/186, 187, 188, 197; 432/40

[56] References Cited

U.S. PATENT DOCUMENTS

| | | | |
|---|---|---|---|
| 3,150,962 | 9/1964 | Pearson | 266/187 X |
| 3,301,544 | 1/1967 | Eft et al. | 266/187 X |
| 3,371,917 | 3/1968 | Mylting | 266/197 X |

*Primary Examiner*—Edward G. Favors

*Attorney, Agent, or Firm*—Fishman and Van Kirk

[57] ABSTRACT

A pulverized solid fuel is injected into a shaft furnace by being entrained in a stream of pressurized air, the resulting fuel-air mixture subsequently being further mixed with heated air being delivered to the furnace via a tuyere. The air used to entrain the pulverized fuel is diverted from the cold air supply to a mixing station, which is used to control the temperature of the hot air supplied to the furnace via the tuyere, and this diverted air is pressurized prior to the pulverized material entrainment.

10 Claims, 1 Drawing Figure

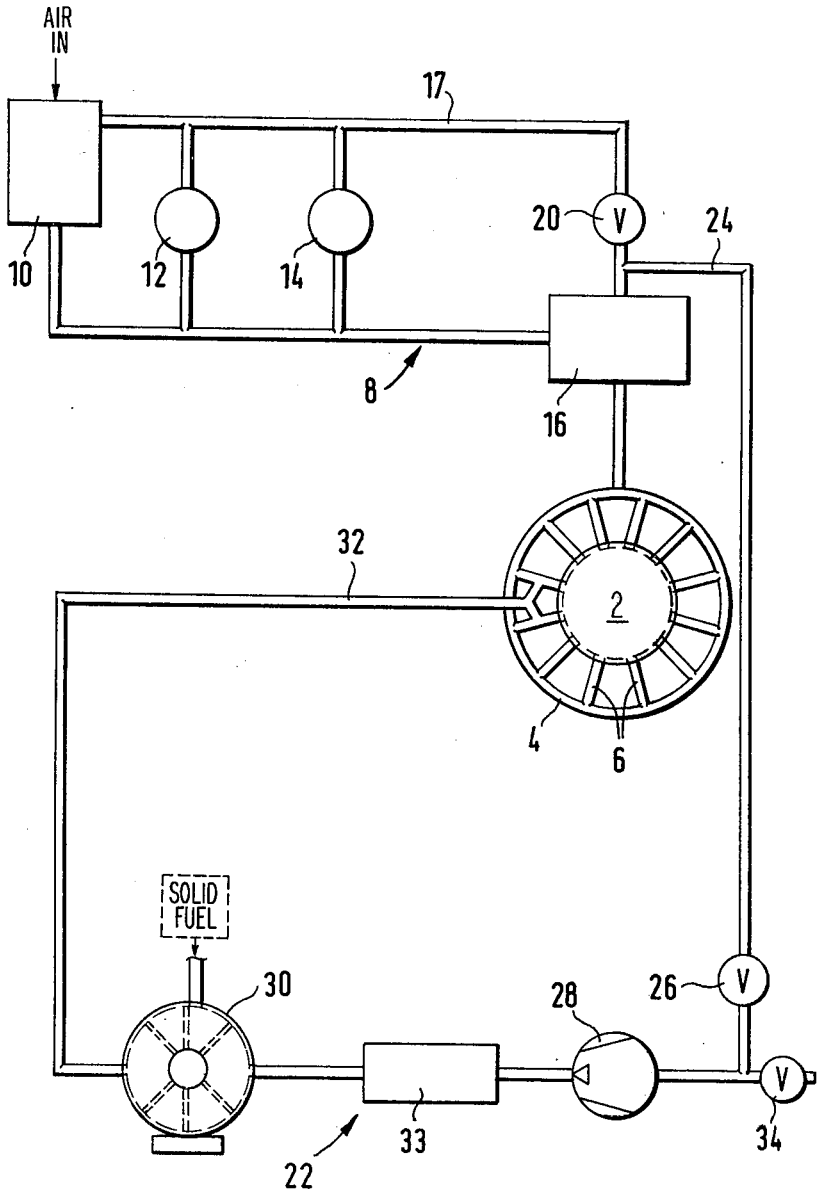
AIR IN
17
10
12
14
20
V
24
8
16
32
2
4
6
SOLID FUEL
30
28
26
V
V
33
34
22

METHOD AND INSTALLATION OF INJECTION OF SOLID FUELS INTO A SHAFT FURNACE

This invention concerns a method for the injection of solid fuels into a shaft furnace, particularly into a blast furnace, and an installation for the implementation of this procedure. A blast furnace is generally equipped with a circular conduit connected to the base of the furnace by a plurality of tuyere stocks and injection nozzles for the injection of hot air-blasts which are produced in an installation comprising a booster, a set of cowpers (also known as hot blast stoves) and a mixing station with two inlets connected to the booster and to each of the cowpers respectively and an outlet supplying the circular conduit with hot air-blasts at a controlled and constant temperature.

With a view to maintaining the reduction process in the blast furnace, the hot air-blast is generally enriched by means of a fuel which is injected into this hot air at the tuyere stocks. Previously, liquid fuels, and more particularly oil products, have been used exclusively as fuels. In effect, these liquid fuels have the advantage of being very easy to handle and the means used for their injection into the nozzles are simple, inexpensive and hardly disturb the operation of other apparatus or installations, and do not deleteriously affect the temperature of the hot air into which they are injected.

However, the growing rise of the price of oil products and the progressive exhaustion of reserves have established the necessity for replacement of these products by other fuels, particularly coal or lignite. It is a known fact that these solid fuels could perform the same function as the liquid fuels as far as the maintenance of the reduction process in the blast furnace is concerned. However, one of the main reasons why solid fuels have not been used previously for this purpose, is that there was no availability of solid fuel handling plants which would have made these fuels competitive vis-a-vis the liquid fuels.

One of the problems which had to be solved before solid fuel could be injected into a hot-air blast, notably that of pneumatic counter-pressure proportioning and transport, has been solved by the apparatus disclosed in co-pending U.S. patent application Ser. No. 158,612, filed June 11, 1980 and assigned to the assignee of the present invention; said application Ser. No. 158,612 being incorporated herein by reference.

In order for a perfect control of the operation of the furnace, it is necessary for the temperature of the hot air-blast to be constant or, at least, controllable. For that purpose, a mixing station has been designed above the circular hot blast conduit, in which a certain quantity of cold air is mixed with the hot air-blast produced in the cowpers, the temperature of which is likely to fluctuate in due course, in order to eliminate these fluctuation peaks and to reduce the temperature of the hot air-blast injected into the furnace to a constant value. If the pneumatic method is used for the injection of solid fuels into the furnaces, it is necessary to employ fairly large quantities of propulsion fluid, which is generally air. But, to avoid auto-ignition of the solid fuel in the pneumatic transport conduits, the temperature of the propulsion air must not exceed 80° to 120° C. In other words, not only is there the risk of destroying the effect of the mixing station by disturbing again the temperature of the hot air-blast by means of the propulsion air, but it will also be necessary either to increase the power of the cowpers to compensate for this loss of temperature or to make do with a lower operational temperature of the hot air-blast.

Consequently, the objective of this invention is to design a new method for the injection of solid fuels into a shaft furnace which avoids the afore-mentioned disadvantages and particularly the disadvantageous affect on the temperature of the hot air-blast by the solid fuel transport fluid. An additional objective of the invention is an installation for implementing this method.

According to the invention there is provided a method for the injection of solid fuels into a shaft furnace equipped with a circular conduit connected to the base of the furnace by a plurality of tuyere stocks and injection nozzles for the injection of hot air-blasts, which are produced in an installation comprising a booster, a set of cowpers and a mixing station with two inlets connected respectively to the booster and to each of the cowpers, and an outlet supplying the circular conduit with hot air-blasts at a regulated and constant temperature, wherein the solid fuel in powdered form is transported and injected pneumatically into each of the injection nozzles. In accordance with the present invention, a portion of the air destined for the mixing station is removed at a point between the booster and the mixing station, and is compressed at a sufficient pressure for the transport and injection of the fuel into the injection nozzles and for compensation of the load losses, and wherein this part of the air is dispatched into a pneumatic fuel transport circuit.

The installation for the implementation of this method is basically characterized by a circuit parallel to the hot air-blast supply circuit of the circular conduit, connected between a point situated in the cold air supply conduit of the mixing station, on the one hand, and each of the injection nozzles on the other hand, and including a compressor and at least one dispenser for the solid fuel.

In accordance with an advantageous method of execution, it is preferable to provide a heat exchanger immediately downstream of the compressor in order to reduce the temperature of the air to a temperature equal to that immediately upstream of the compressor, so as to avoid exceeding the auto-ignition temperature of the fuel.

The dispenser for the fuel is preferably formed by a series of cellular wheel sluices, the number of which may be equal to half the number of nozzles so that one sluice is linked to one pair of nozzles.

Other features shall emerge from the detailed description of a method of execution presented below, by way of example, with reference to the single FIGURE which shows a schematic diagram of a solid fuel injection installation in accordance with this invention.

This FIGURE shows diagrammatically a blast furnace 2 equipped with a circular conduit 4 for the supply of hot air-blast. This circular conduit 4 is connected to the base of the furnace by means of a series of tuyere stocks 6 connected to injection nozzles which are not shown, embedded in the wall of the furnace. The hot air-blast for feeding the circular conduit 4 and the tuyere stocks 6 is produced in installation 8 comprising basically a set of cowpers 12, 14 well known in themselves. For further information with regard to "cowpers" or hot blast stove installations, reference may be had to U.S. Pat. No. 2,931,635. These cowpers are in fact furnaces designed to reheat the cold air coming from a booster 10 to a temperature greater than that of the hot air-blast injected into the furnace. The operation of such a cowper consists of two phases, i.e. a reheating and heat accumulation phase and a phase for removal of the heat accumulated and reheating of the cold air. Consequently, in order to ensure a continuous operation, at least one pair of cowpers is necessary, the two stoves working in alternation.

The description "cold" of the air dispatched by the booster 10 into the cowpers 12 and 14 is not significant, as the temperature of this "cold" air is approx. 100° to 120° C. because of the reheating in booster 10. The temperature of the hot air at the outlet of the cowpers depends on the thermal requirements at the level of injection into the furnace. When the hot air injected into the furnace must have a temperature of approx. 1200° C., the reheating produced in the cowpers 12, 14 must rise approx. to 1300° C. to compensate the heat losses and to ensure a constant temperature in a mixing station 16.

The aim of this mixing station 16 is to ensure a constant temperature of the hot air-blast with a view to its injection into the furnace. In effect, it is not possible to have a constant and uniform temperature at the outlet of the cowpers where there are always fluctuations of several dozen degrees. This is therefore the reason why it is necessary to heat the hot air-blast in the cowpers to a sufficient temperature in order to be able to reduce it to a uniform temperature in the mixing station 16, by intake of a proportioned quantity of cold air via a conduit 17 connected to the booster 10. The necessary quantity of cold air taken into the mixing station 16 via conduit 17 is automatically regulated by an automatic valve 20 which regulates the flow of cold air in accordance with the temperature of the hot air-blast in the circular conduit. In this way, it is ensured that the temperature of the hot air-blast injected into the furnace remains constant.

This hot air-blast producing installation 8, such as represented on the FIGURE, is in accordance with the state-of-the-art and does not constitute a part of the present invention. In accordance with the present invention, a parallel circuit 22 is grafted onto this installation 8, for the pneumatic injection of solid fuels into each of the furnace nozzles. For this purpose, a conduit 24 is provided, connected onto the cold air intake conduit of the mixing station 16 between the latter and the valve 20. The conduit 24 is designed to withdraw the quantity of air necessary for the pneumatic propulsion of the solid fuel. The flow of propulsion air diverted into conduit 24 is controlled automatically by valve 26.

In circuit 22, a compressor 28 has been provided, designed to raise the pressure of the propulsion air in circuit 22 so as to compensate the load losses and ensure injection into the furnace. The difference of the pressure produced in the compressor 28 is generally 2 bars, counting approx. 1 bar for the compensation of the load losses and a reserve of one bar to ensure injection. Consequently, if the pressure of the hot air-blast to be injected into the furnace is approx. 2.5 bars, the pressure of the propulsion air downstream of the compressors 28 is approx. 4.5 bars.

The intake of the solid fuel in powdered or crushed form into circuit 22 is carried out with the aid of a cellular wheel sluice 30, which is well known in itself. This solid fuel, which may be lignite powder or coal dust, is then propelled through conduit 32 into the injection nozzles. For example, two nozzles can be fed by one single conduit 32, so that the number of conduits 32 and the number of sluices 30 shall be equal to half the number of nozzles. This ratio can be changed as necessary.

It should be noted that the propulsion air undergoes reheating in the compressor 28. In order to prevent the temperature of the propulsion air from reaching the auto-ignition threshhold of the solid fuel and also in order to reduce the temperature to a value which is approx. equal to the temperature at the point where the propulsion air is removed, i.e. between valve 20 and station 16, it is preferable to provide a cooling device 33 downstream of compressor 28. The activity of this cooler 33 can be controlled automatically in accordance with the reheating in compressor 28. In this way, if the temperature of the cold air circulating in conduit 17 is approx. 120° C., it can be arranged that the temperature of the propulsion air in conduit 32, particularly at the time of injection into the furnace, is also 120° C. approximately.

As can be ascertained, the integration of circuit 22 into the hot air-blast production circuit 8 does not disturb the operation of the latter and in particular the temperature of the hot air-blast injected into the furnace, in any way. In effect, the quantity of cold air required by the mixing station 16 for maintaining a constant temperature of the hot air-blast, is determined by valve 20 and this quantity will always pass via this valve. The difference is that part of the air discharged through valve 20 is no longer conveyed into the mixing station 16, but through circuit 22 so that the total quantity of cold air mixed with the hot air-blast produced by the cowpers does not change. Part of the mixing, instead of being carried out in the mixing station 16, is now effected at the level of the injection of fuel into the blast furnace.

In the case that the operation of the furnace is reduced, i.e. the quantity of hot air-blast is reduced to a minimum, and valve 26 is closed, a valve 34 has been designed which allows the intake of atmospheric air into circuit 22.

I claim:

1. A method for the injection of solid fuel into a shaft furnace, the furnace being provided with a common hot air supply conduit which is coupled to the interior thereof by means of a plurality of tuyere stocks, the furnace further including external means for producing heated air and a mixing station whereby the temperature of the heated air is reduced to a controlled level by mixture with relatively cold air, said method comprising the steps of:

diverting a portion of the cold air being delivered to the mixing station;

raising the pressure of the diverted air, the temperature of the air increasing with the increase in pressure;

entraining a pulverized solid fuel in the pressurized air to form a fuel/air mixture; and injecting the fuel/air mixture into at least a first tuyere stock whereby the said fuel/air mixture is delivered into the furnace along with heated air discharged from the mixing station.

2. The method of claim 1 further comprising the step of:

reducing the temperature of the diverted air subsequent to raising the pressure thereof to compensate for the heating thereof during compression.

3. Apparatus for use in injection of solid fuel into a blast furnace, the furnace being provided with a common hot blast air supply conduit and a plurality of tuyere stocks for coupling the hot blast supply conduit to the furnace interior, the furnace being associated with a hot blast stove installation which produces hot air for subsequent delivery into the hot blast conduit, the hot blast stove installation including means for mixing the hot air produced therein with relatively cold gas to thereby control the temperature of the hot air delivered into the hot blast conduit, said solid fuel injection apparatus comprising:

means for diverting some of the cold gas being directed to the hot blast stove installation mixing means;

means for compressing the air flowing through said diverting means;

means for causing entrainment of pulverized solid fuel in the air discharged from said compressing means to form a fuel/air mixture; and means for delivering the fuel/air mixture produced by said entrainment causing means into at least a first of the furnace tuyere stocks for mixture with hot air from the hot blast conduit and subsequent injection into the furnace.

4. The apparatus of claim 3 further comprising:

means for cooling the air discharged from said compressing means prior to the delivery thereof to said entrainment causing means.

5. The apparatus of claim 4 wherein said cooling means comprises:

a heat exchanger.

6. The apparatus of claim 3 wherein said entrainment causing means comprises:

a cellular rotary feeder.

7. The apparatus of claim 4 wherein said entrainment causing means comprises:

a cellular rotary feeder.

8. The apparatus of claim 3 wherein said delivering means is connected to a plurality of the tuyere stocks.

9. The apparatus of claim 4 wherein said delivering means is connected to a plurality of the tuyere stocks.

10. The apparatus of claim 7 wherein said delivering means is connected to a plurality of the tuyere stocks.

* * * * *

UNITED STATES PATENT AND TRADEMARK OFFICE

CERTIFICATE OF CORRECTION

PATENT NO. : 4,325,312

DATED : April 20, 1982

INVENTOR(S) : Leon Ulveling

It is certified that error appears in the above-identified patent and that said Letters Patent are hereby corrected as shown below:

Column 1, line 68, cancel "power" and insert --output temperature and thus the power consumption--

Signed and Sealed this

First Day of March 1983

[SEAL]

Attest:

GERALD J. MOSSINGHOFF

Attesting Officer

Commissioner of Patents and Trademarks